US005141112A

United States Patent [19]

Holbert

[11] Patent Number: 5,141,112

[45] Date of Patent: Aug. 25, 1992

[54] VENEER STACKING SYSTEM

[75] Inventor: John C. Holbert, Corvallis, Oreg.

[73] Assignee: U.S. Natural Resources, Inc., Vancouver, Wash.

[21] Appl. No.: 478,429

[22] Filed: Feb. 12, 1990

Related U.S. Application Data

[63] Continuation-in-part of Ser. No. 178,478, Apr. 7, 1988, Pat. No. 4,905,843.

[51] Int. Cl.[5] ..... B07C 9/00

[52] U.S. Cl. ..... 209/653; 60/581; 60/584; 60/588; 91/4 R; 209/552; 209/933; 414/791.1

[58] Field of Search ..... 209/539, 552, 564, 565, 209/651, 652, 653, 905, 933; 414/791.1; 60/581, 584; 271/177, 180, 194, 197; 91/4 R

[56] References Cited

U.S. PATENT DOCUMENTS

| | | | |
|---|---|---|---|
| 2,490,823 | 12/1949 | Manning | 91/4 |
| 2,499,563 | 3/1950 | Bill | 60/580 X |
| 2,867,090 | 1/1959 | Pfeifer | 60/584 |
| 3,100,965 | 8/1963 | Blackburn | 91/4 R X |
| 3,227,275 | 1/1966 | Cody | 414/134 X |
| 3,583,562 | 6/1971 | Yock et al. | 209/74 |
| 3,812,964 | 5/1974 | Woodruff | 209/73 |
| 3,955,678 | 5/1976 | Moyer | 209/564 |
| 4,155,223 | 5/1979 | Falk | 60/588 |
| 4,318,460 | 3/1982 | Kosinski | 60/584 X |
| 4,351,153 | 9/1982 | Kosmala | 60/581 |
| 4,511,242 | 4/1985 | Ashbee et al. | 355/14 C |
| 4,905,843 | 3/1990 | Holbert | 209/571 |

*Primary Examiner*—Michael S. Huppert
*Assistant Examiner*—Joseph A. Kaufman
*Attorney, Agent, or Firm*—Robert L. Harrington

[57] ABSTRACT

In a veneer stacking system, a sensing device for sensing the incoming veneer sheets and computer determining from the information of the sensing device the stack on which the sheets are to be deposited. Knock-off shoes are positioned above the path of incoming veneer sheets. Multiple hydraulic cylinders connected into a hydraulic control system controls movement of the shoes. The multiple cylinders are simultaneously actuated by master cylinders which in turn are simultaneously actuated by a computer controlled mover piston. Air leaked into the hydraulic system is bled off by bleed orifices in the master cylinders communicating with a hydraulic fluid reservoir whereby air rises in the system up through the orifices and into the reservoir.

9 Claims, 5 Drawing Sheets

VENEER STACKING SYSTEM

This is a continuation-in-part of U.S. application for Patent, Ser. No. 178,478, filed Apr. 7, 1988, now U.S. Pat. No. 4,905,843.

FIELD OF THE INVENTION

This invention relates to a veneer stacking operation and method, and more particularly to improvements that enable individual veneer sheets to be aligned in stacks for damage-free handling.

BACKGROUND OF THE INVENTION

Plywood production involves the peeling of a thin continuous layer of veneer from a log, e.g. 0.1 inch thick. The veneer as peeled is a continuous ribbon that has a width corresponding to the length of the log being peeled. It is cut into individual sheets of varying sizes. The individual sheets are typically analyzed and stacked by a stacker according to size, grade and moisture content. The sheets are subsequently unstacked, dried and restacked, again by a stacker according to size, grade and moisture content. The acceptable sheets are then made into plywood consisting of laminated sheets of veneer.

It is to be particularly noted that two stacking operations are involved. One is referred to as the stacking of green veneer sheets and the other as the stacking of dried veneer. Whereas there are differences as between the two stacking operations, the improvements provided by the present invention are equally applicable to both of these stacking operations. Hereafter all references to "stacking" unless specifically identified otherwise, have reference to both green and dry veneer stacking operations.

The sheets when distributed to the stacker are separated into designated stacks. For example, one stack may be designated for half sheets having a low moisture content, one for half sheets having a high moisture content, and one stack for moderate or acceptable moisture content. Similar designations of stacks are provided for the full sheets. Other designations are also quite common, e.g. according to grade.

A common full sheet size is 101 inches by 54 inches and half sheets are 101 inches by 27 inches. However, the invention is not limited to a specific sheet size or to designation as between full and half sheets. Those familiar with the veneer peeling art will recognize application of the invention to all usable sheet sizes including what is referred to as strips and fish tails. Hereafter reference to veneer sheets encompasses all such size variations of usable veneer unless otherwise indicated.

The stacking operation is automatic or in some instances semi-automatic and, as contemplated herein, includes an in-feeding conveyor belt that conveys the individual sheets in sequence to an automatic stacking apparatus. The sheets are analyzed for size, moisture content and grade and then transferred from the incoming conveyor, on which the sheets are bottom supported, to the stacking conveyor, (a plurality of overhead belts) on which the sheets are top supported.

As concerns the overhead or stacking conveyor, air is drawn upwardly through the belts of the conveyor and the suction thus created adheres or attaches the sheets to the overlying surface of the belt. The belt conveys the sheets along the path over the stacking bins which are designated for sheets of specific size and range of moisture content (and where applicable by grade). Knock-off shoes positioned over the conveyor and in line with the bins are activated to dislodge or detach the sheets from the conveyor and deposit them on the stacks in the bins.

The primary consideration of this invention is to deposit the sheets uniformly on the stacks. In particular, the leading edge of the sheet must be carefully deposited to line up with the leading edge of the stack A number of factors effect this alignment.

If the sheets aren't properly aligned on the overhead belt, they cannot be properly aligned on the stack. Thus the sheets must be properly aligned on the overhead belts.

If the air suction is greater for one sheet than another, i.e. if the suction is not consistent, successive sheets may be released differently and cause misalignment. Thus consistent air suction is desirable.

The left and right or front and back cylinders of the knock-off mechanism can be slightly out of sync and this can cause skewing. Thus the knock-off mechanism needs to be synchronized.

The different weights of the sheets due to moisture variation can change the forward momentum of the sheets as they are transferred to the stack. Thus sheets having different moisture content must be knocked off the conveyor at different positions in order to achieve the desired line up of all the differently weighted sheets within the stack.

All of these problems, in accumulation, typically provide significant misalignment of the sheets in the stack of sheets. Subsequent handling as when a forklift engages the stack, often damages the protruding edge of the misaligned sheets at a very substantial cost to the producer.

BRIEF DESCRIPTION OF THE INVENTION

This invention concerns the apparatus including the knock-off shoes. The knock-off shoes are typically activated by hydraulic or pneumatic (fluid) cylinders. There are two elongated shoes positioned above the sheet at the sides of the overhead conveyor belts and thus above the corresponding side edges of the sheets. Each shoe is activated by a pair of cylinders, i.e. a front and a rear cylinder. Thus there are four "shoe" cylinders that cooperatively act to dislodge the sheet from the conveyor.

The precision that is required by the knock-off shoes must be appreciated in order to comprehend the significance of the present invention. Two identical hydraulically actuated cylinders manufactured at the same time under the same tolerances will not respond identically to simultaneous actuation. The difference, though small, is enough to cause a percentage of the stacked sheets to become offset in the stack. The sheets are being transferred from the overhead conveyor at the rate of one sheet per second or higher. The shoes must be simultaneously extended and retracted within that interval. Whereas slight variation in a single hydraulic cylinder can be tolerated in the system through computer adjustment of the precise point of actuation, the variation as among a plurality of cylinders cannot be tolerated. Therefore, an objective of the invention is to produce a system where all four shoes will respond simultaneously.

Air valves are particularly suited to rapid response time such as required for cycling of the knock-off shoes. However, air is compressible and simultaneous actuation of four separate shoes through four separate pneumatic air lines will not achieve the desired precision. The solution of the present invention is to provide pneumatic actuation of a common mover piston which directly drives the pistons of four master hydraulic cylinders. The master hydraulic cylinders are each connected through hydraulic lines in a closed hydraulic system to a corresponding hydraulic actuated shoe cylinder (e.g. four hydraulic systems, one each for the front and back cylinders of each of the two shoes).

The shoe cylinders all respond identically to movement induced by the mover piston. The mover piston will introduce potential errors but these errors are readily extracted through adjustment by the computer.

Whereas it is next to impossible to prevent air bubbles from leaking past the seals and into the hydraulic lines, and whereas any air in the lines will produce the undesired variation in response time as between the four hydraulic systems, a further object of the invention is to provide means for bleeding off the air that gets into the hydraulic system.

The prior art considered to be most pertinent to the present invention includes the following:

Cody U.S. Pat. No. 3,227,275 typifies the knock-off shoes used in a veneer sorting and stacking system. A single hydraulic piston is mechanically linked to the knock-off shoes. The desired response time is very difficult if not impossible to achieve in the system and any wearing of the various moving parts will cause the shoes to operate out of sync.

Operation of multiple motor means by a single motor means is not itself new as illustrated by Bill U.S. Pat. No. 2,499,563. Bill discloses a single hydraulic motor that operates multiple hydraulic motors connected to lifting jacks for uniformly raising a vehicle. Bill does not provide the insight for achieving computer control of a discharging mechanism like veneer sheet knock-off shoes that have to be cycled in a second or less and wherein operational variations as between the knock-off shoes that can be measured in milliseconds is not considered acceptable simultaneous operation.

The present systems utilize computer operation for controlling and adjusting the actuation of an air over hydraulic system for precisely removing veneer sheets from an overhead conveyor. The simultaneous actuation of the hydraulic cylinders is insured in part by the ability to remove entrained air bubbles.

These improvements will be more clearly understood and appreciated by reference to the detailed description and the drawings referred to therein as follows.

Figure 1:
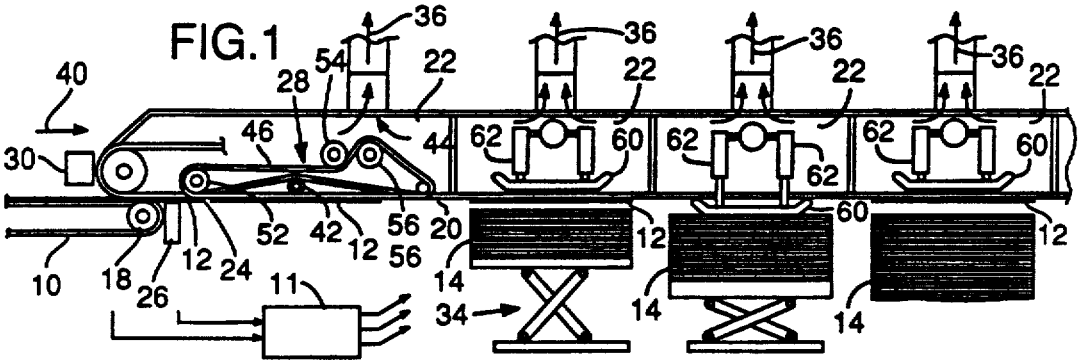
FIG. 1 is a schematic side view of a veneer stacking system incorporating the features of the present invention.

Reference is made to FIG. 1. Illustrated is a conveyor belt 10 that conveys, in sequence, the veneer sheets 12 that have been clipped in a prior operation to the desired size. Whereas many different sizes of partial sheets result from this clipping operation, as contemplated for the preferred embodiment, only the full sheets and half sheets are directed to the stacking operation. Both half and full sheets are oriented or positioned with the longer dimension, i.e. the 8' plus side as the lateral or leading edge. The depth or length of the sheets as determined by the path of travel is either 4' for full sheets or 2' for half sheets. The bins in which the half and full sheets are deposited are interchangeable and thus except for the designation process and the point of release, the invention herein is applicable to both the half and full sheets (and as previously explained, for stacking either green or dry veneer sheets).

In the prior clipping operation, the sheets have been cut to the same dimensions if full sheets and to the same dimensions if half sheets, e.g. 101"×54" or 101"×27". The object of the stacking operation is to categorize the full and half sheets by size, moisture content (and grade, if applicable) and then stack the sheets accordingly, as illustrated by the stacks 14. Only three stacks are shown but typically there are six or more as determined by the need of any particular stacking operation. These stacks are segregated into stacking bins the structure of which is eliminated for clarity.

The veneer sheets are fragile, being only about 0.1 inch thick and this stacking operation and the subsequent handling of the sheets must be done with care so as not to damage the sheets. Yet speed is of utmost importance as well. To damage even a small percent of the sheets during the stacking and stack-handling operation is very costly. A damaged sheet in a stack of sheets can be passed all the way to the point where it is laid up in a plywood panel (including a number of laminated sheets of veneer). The entire plywood panel, being defective is then designated as waste. Hundreds of thousands of dollars can be lost to a plywood mill in this manner. Automatic machinery for delicately and speedily accomplishing these operations is worth substantial investment in stacking and stack-handling improvements.

Stack-handling is not a part of the present inventions except to recognize that the achievement of squared-up stacks is considered essential to enable damage-free stack handling. That is, the veneer sheets are desirably stacked one on top of another exactly in line so that corners and edges do not project out from the stack. Such projected edges and corners are a common cause of damage in the subsequent stack-handling operation.

Each of the stacks 14 are supported on conventional adjusting scissors-type stack holders 34. The adjustment feature maintains the top of the stack in close proximity to the knock-off shoes to be explained hereafter. The stack unloading apparatus is also conventional to existing stackers and is not illustrated. The inventive features concern the manner of depositing the sheets 12 onto the stacks 14.

The sheets 12 are transferred from a conventional bottom supporting belt conveyor 10 to the stacker conveyor which is a top supporting overhead conveyor 20 (consisting of multiple conveyor belts which will be referred to as conveyor belts 20). Just prior to this transfer, however, the moisture content of the sheet is detected by detector 30. Although important for achieving stack designation, such detectors are well-known and will not be specifically described herein.

The overhead conveyor is enveloped in a housing consisting of a plurality of air chambers 22. The first of these chambers 22 is the set-up chamber. Three functions are accomplished within the space of this first chamber. The sheets 12 are transferred from the conveyor 10 to the overhead conveyor 20 as indicated in FIG. 1. The leading edge 24 of the sheet 12 is then sensed adjacent the corners, by optical scanners 26. These scanners will detect the edge 24 simultaneously if the sheet 12 is properly aligned on the belt.

Figure 2:
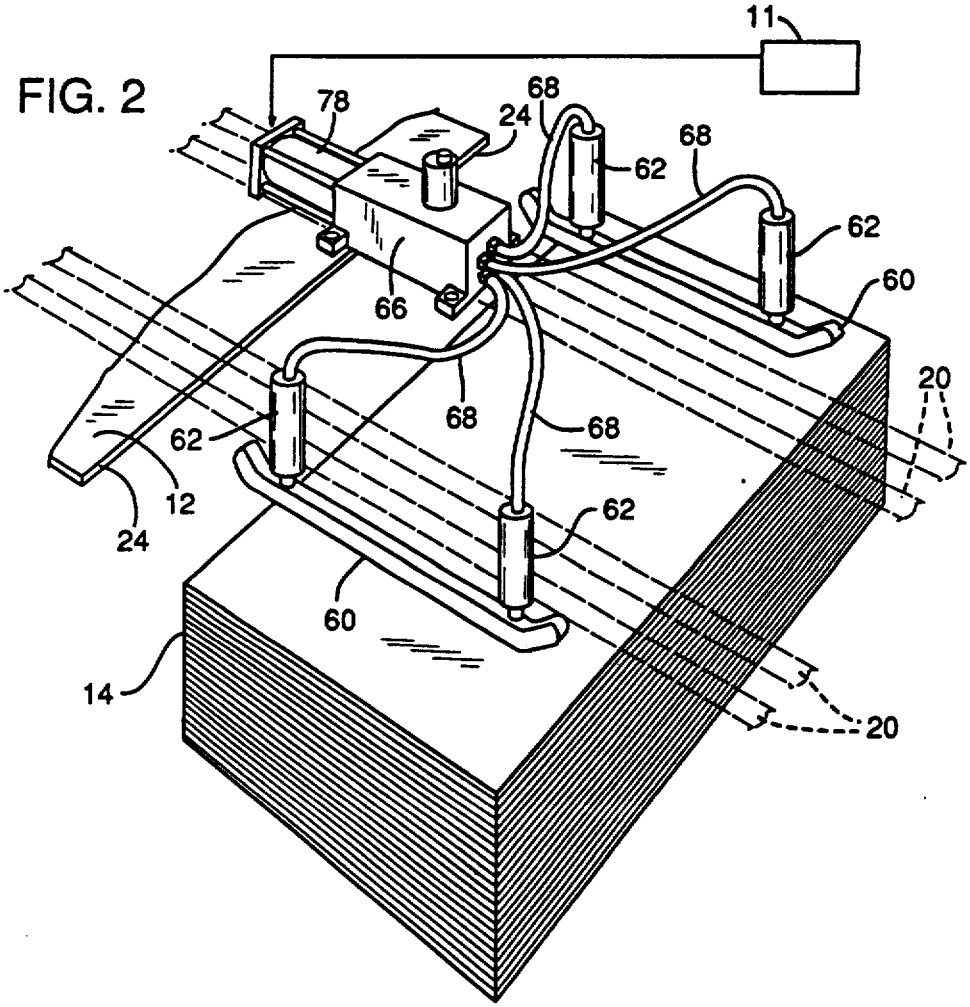
FIG. 2 is a perspective view of the knock-off shoes and actuating mechanism utilized in the veneer stacking system of FIG. 1.

If the sheet is misaligned, the extent of misalignment will be determined by a pulse generating device. For example, the trailing side of the sheet may be detected by the device five pulses later than that detected for the leading side. The trailing side must accordingly be accelerated to make up this five pulse differential. Such pulse generating devices are well known and will not be further explained. The computations and controls for the pulse generating device and other functions of the veneer stacking system are provided by a computer 11 as will be further explained and which is illustrated in FIGS. 1 and 2. The use of computers for lumber processing is also well known in the art and accordingly explanation of the computer and its operation is not provided in detail.

The next operation of the system taking place within the first or set-up chamber 22 is the realignment of any misaligned sheet 12. This is accomplished by the mechanism at each side of the conveyor 20 generally indicated by reference 28.

Whereas the veneer sheets are typically conveyed into the stacker in orderly succession one after the other, the area covered by the sheets 12 within the first chamber 22 is substantially consistent. Because the sheets are not being knocked off the conveyor within this first chamber, a changing vacuum pressure does not create the problem as occurs over the plurality of stacks 14 on which the sheets are deposited.

Once the sheets have been categorized by moisture content, size and grade (if applicable), and then aligned on the overhead belts 20, they are ready to be deposited on the appropriate stack 14. As shown in FIG. 1 particularly, the sheets 12 are conveyed by overhead conveyor 20 through the plurality of air chambers 22. EAch of these successive chambers following the set-up chamber, is associated with a pair of knock-off shoes 60 that is aligned over each of the stacks 14.

As is typical for stackers in general, the sheets 12 are adhered to the overhead conveyor or belts 20 by air. The belts 20 are provided in pairs and air is drawn between the belts and exhausted from the chambers 22 through a conduit connected to a vacuum source, indicated by arrows 36 (FIG. 1). More specifically, as particularly seen in FIG. 2, a pair of belts 20 are provided on each side of the conveyed sheets.

Each of the chambers 22 are independently served by a negative air source. Thus the vacuum force that is generated is controlled to accommodate the effect of the presence or absence of but one sheet in that chamber. This concept of separating the housing into independent chambers is considered a major factor in accomplishing the desired "squared-up" stacking of the veneer sheets in the improved system described herein. The "squared-up" stacking in turn significantly reduces damage and dramatic savings to the mill operation.

As previously explained with reference to FIG. 1, the sheets 12 which are transferred from conveyor 10 to conveyor 20 may not be properly aligned. What this mean is that the leading edge 24 of the sheet 12 is not perpendicular to the path of travel. The sheet 12 will thus be skewed on the conveyor and one side of edge 24 will be leading the other side of edge 24. When this happens, the sensors or scanners 26 will detect the extent of the skew and the computer 11 will compute the need for adjustment. For example, considering the relative positions of the two pairs of belts 20, the computer can determine that one of the pairs needs to advance or retract some determined distance relative to the other belt in order to draw the sheet 12 into a squared-up position on the conveyor (with leading edge 24 perpendicular to path 40). Of course, conveyor 20 is controlling the movement of a plurality of sheets and to speed up or slow down one pair of belts 20, while producing alignment of one sheet, will misalign all the other sheets on the conveyor. Thus the system herein contemplates the intercession of an aligning mechanism 28 (a designation used for the aligning mechanism on both sides of the stacker).

The intercession of the aligning mechanism 28 is enabled by taking the belts 20 out of operation for a portion of the veneer sheet conveyance. The belts 20 on both sides are drawn out of the patch of travel by deflecting rollers 42. The belt is repositioned back into the path by rollers 44 at a spaced distance down the path of travel. Aligning belt 46 (and its paired counterpart) is positioned respectively between the right and left hand pairs of belts 20 (as viewed along the path of travel) and assumes control over the sheets 12 during this portion of travel of the sheets 12 through the stacker. Belt 46 follows a path along the path of conveyor 20. The belt 46 passes from rollers 52 to and around end rollers 44, then up and around drive rollers 56 and tensioning rollers 54, and back to end rollers 52. This configuration is commonly referred to as an S drive.

Drive rollers 56 are controlled by the computer The computer receives the information from the scanners 26, calculates the amount of skew and from that, the necessary advance or retreat of belt 46. The computer accordingly instructs the drive rollers 56. When the sheet 12 is placed into the control of belt 46 and prior to the transfer of control to the belts 20 at rollers 44, the drive rollers 56 speed up or slow down to effect the desired alignment.

THE KNOCK-OFF MECHANISM

The function of the knock-off mechanism is to force the veneer sheets downward off of the overhead conveyor belts 20 and to directly and positively place them onto the stacks 14. The stacks 14 are maintained at a specific spacing below the conveyor belts 20 due to the scissor support mechanism 34 (a mechanism well known to the industry). The knock-off mechanism pushes the sheets free of the belts 20 (and thus free of the influence of the air flow through the belts) and presses the sheets directly onto the stacks 14. As shown in FIG. 2, the knock-off mechanism includes right and left hand knock-off shoes 60 spaced just outside of the pairs of belts 20. The shoes 60 are each controlled by front and rear shoe cylinders 62.

It will be understood that until the shoes are activated to sever the influence of the air suction 36, the veneer sheet 12 is being drawn along the path of the belts 20. It will be further appreciated that having one side of the sheet severed from the influence of the air pressure even slightly before or after the other side, will re-introduce skewing of the sheet. If the sheet is skewed, it will not be stacked properly and the undesired damage will likely result. Thus it is imperative that the shoe cylinders 62 on the two sides of the sheet 12 are activated simultaneously so as to maintain the squared-up position. In the present case, it is desirable to activate all four shoe cylinders 62 simultaneously to accomplish this transfer of the sheets 12 from the belts 20 to the stacks 14.

Figures 7, 9:
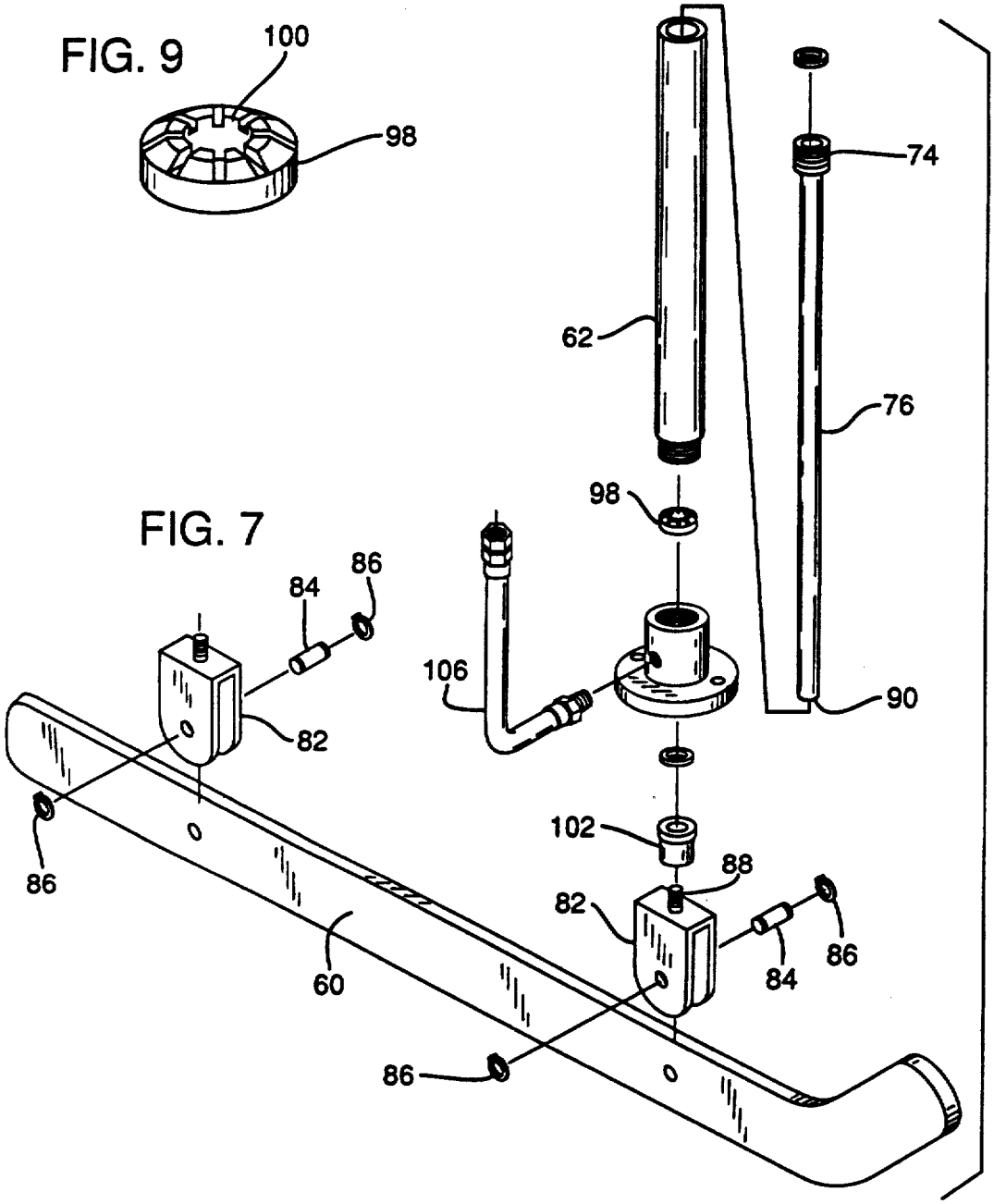
FIG. 7 is an exploded perspective view of the components of the knock-off shoes.
FIG. 9 is a perspective view of a seal utilized in the shoe cylinder of FIG. 8.
Figure 8:
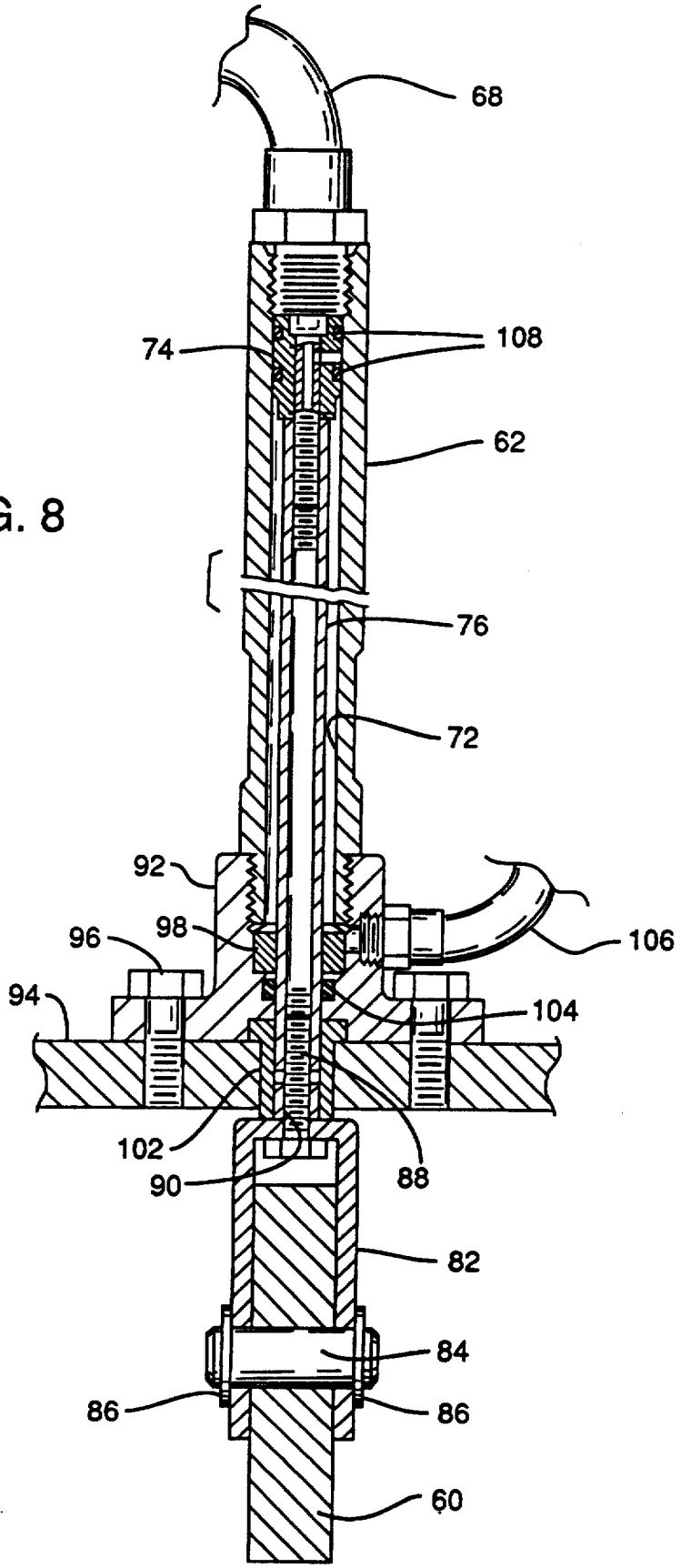
FIG. 8 is a section view of the shoe cylinder as seen in exploded view in FIG. 7.

When referring to the drawing, FIG. 2 illustrates in general the knock-off shoes and operating mechanism, FIGS. 3-6 illustrate the details of the pneumatic over hydraulics operating mechanism, and FIGS. 7-9 illustrate in detail the response mechanism including the knock-off shoes. From FIG. 2, the four shoe cylinders 62 are assured of simultaneous activation by coupling them to four master cylinders 64 that are simultaneously activated by a common pneumatic cylinder 78. The master cylinders 64 are contained in a common housing 66 and are respectively interconnected to four lines 68. From FIGS. 3-6, liquid movement through the four lines 68 are equally affected by simultaneous movement of the four pistons 80 in the four master cylinders 64. This simultaneous movement is ensured by the provision of a common mover piston 70 (pneumatic driven) also located in the housing 66. Activation of piston 70 (by pneumatic pressure) generates simultaneous movement of pistons 80 of the respective master cylinders 64 and (as seen in FIGS. 7 & 8) corresponding simultaneous movement of pistons 74 in shoe cylinders 62. (The diameters of the respective cylinders and lines 68 being equal.) This concept of hydraulic drive for the four master cylinders 64 results in equal liquid displacement in each of the lines 68 and therefore in each of the inner chambers 72 of shoe cylinders 62. This liquid displacement generates co-equal movement of pistons 74 and piston rod 76 in cylinders 62 and thus equal movement of shoes 60 connected to piston rod 76.

The components making up the shoe and shoe cylinder as particularly seen in FIGS. 7-9 includes brackets 82, fastened by pins 84 to the shoes, the pins being held in place by spring clips 86. Bolts 88 fasten the bracket 82 and thus the shoe 60 to the threaded end 90 of the rod 76.

Shoe cylinder 62 is screwed into a mounting flange 92 which in turn is mounted with bolts 96 to a plate 94 that is secured to the housing and is in a fixed position relative thereto. Seated in the mounting flange 92 is a seal 98 which defines a bearing hole 100 through which piston rod 76 slides. A second seal 102 in the bottom of the flange is also provided to inhibit air leakage as the rod 76 is moved up and down in response to actuation of the piston 74. An O ring 104 is trapped within the mounting flange 92 and aids the sealing around rod 76 as it moves up and down through the flange.

The purpose of the seal and 0 ring is to enable the function of an air actuated return of the rod 76 and piston 74. Plant air typically at about 80 psi is directed into the flange 92 through line 106 just above seal 98. Chamber 72 is thus subjected continuously to an 80 psi pressure and functions much like a return spring. The seals 108 surrounding piston 74 are subjected to this constant pressure. Piston 74 responds to the greater of the two forces, i.e. the hydraulic pressure generated by mover piston 70 or the air pressure generated by air from line 106. The hydraulic force overcomes the plant pressure with the piston 74 actuated and the rod 76 is forced downward through the flange 92. Retraction of the mover piston 74 relieves the force from above the piston 74 and the air pressure in chamber 72 insures the rapid return of the rods 76.

A problem is introduced by reason of the high pressure that is created between the seals 108 during normal operation. Air will leak past the seal and mix into the hydraulic fluid as air bubbles. Such air in the hydraulic system cannot be tolerated and the means for bleeding off this air is particularly illustrated in FIGS. 3 and 4.

It will be understood from FIGS. 1 and 2 that the cylinders 64 are positioned above the chamber 62 and lines 68. Moreover, the cylinders 64 are slightly angled upwardly front to back so that the rear of the cylinder (left side in FIG. 4) is the highest point in each of the closed hydraulic systems operating the four shoe cylinders 62. It follows that any air that is leaked into the system, e.g. past seals 108 will rise in the hydraulic line to the upper rearwardmost point in the respective cylinders 64.

Figure 3:
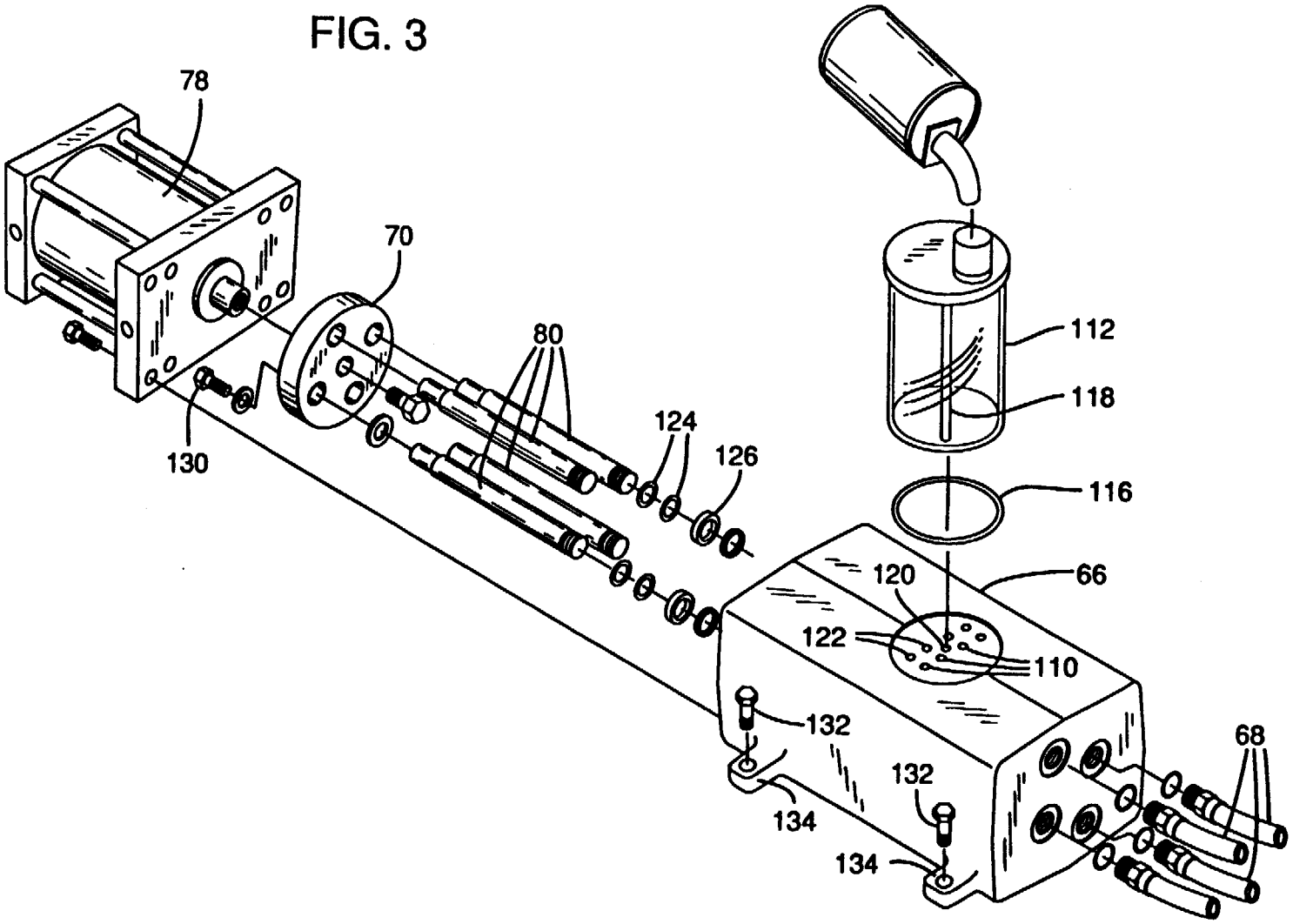
FIG. 3 is an exploded view of the actuating mechanism of FIG. 2.
Figure 4:
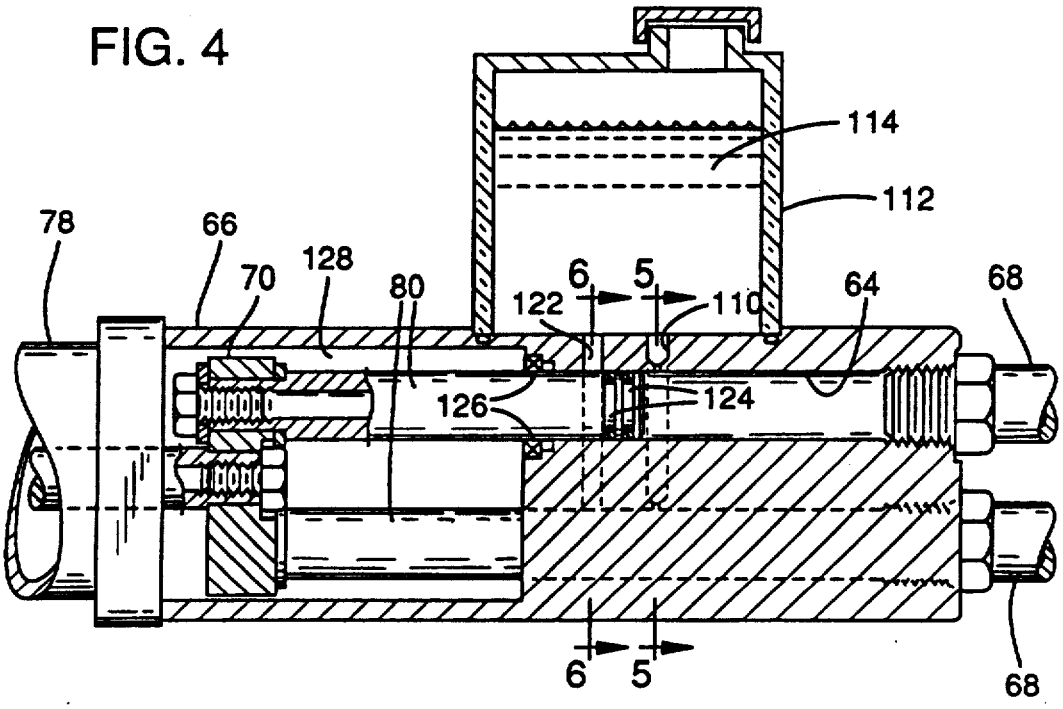
FIG. 4 is a section view of the actuating mechanism of FIG. 3.
Figure 5:
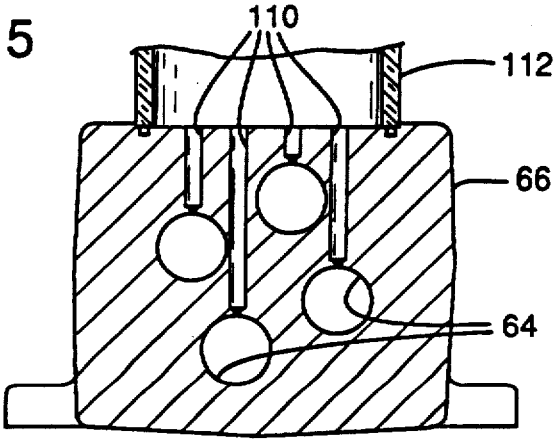
FIG. 5 is a section view as taken on view lines 5—5 of FIG. 4.
Figure 6:
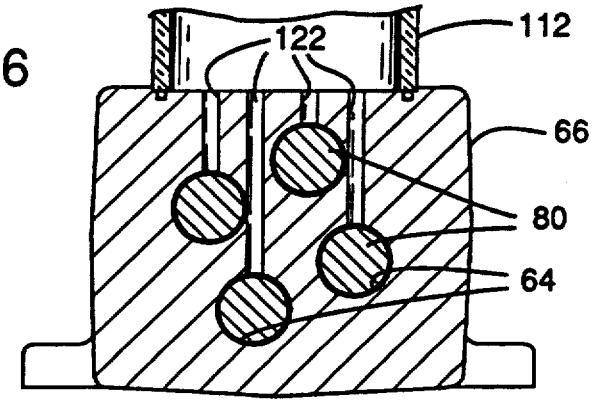
FIG. 6 is a section view as taken on view lines 6—6 of FIG. 4.

FIG. 4 illustrates the pistons 80 in the withdrawn position and bleed off orifices 110 are located in the housing 66 to communicate with the interior of cylinder 64 just forward of the piston seals 124 on the end of piston 80 in the withdrawn position (see also FIGS. 5 and 6). The bleed off orifices extend through the housing wall upwardly into communication with a hydraulic fluid reservoir 112. As illustrated in FIG. 3, this reservoir 112 contains a quantity of the hydraulic fluid 114. Whereas the reservoir may be provided in a number of forms, as shown, the reservoir canister has an open bottom configured to fit the outer wall of housing 66, being sealed against the wall by sealing ring 116 and fastened with bolt 118 that is screwed into screw hole 120 of the housing.

In operation, air that leaks past seals 108 will rise in line 68 and flow to the rear of cylinder 64. There they will continue to rise in the hydraulic fluid up through orifices 110 and into the hydraulic fluid of reservoir 112. The hydraulic lines are thereby continuously purged of air bubbles and errors that can result due to air compression are avoided.

A second set of bleed orifices 122 are provided behind the seals 124 on the end of piston 80, and a sealing gasket 126 seals the rear end of the cylinder chamber 64 behind orifices 122. Hydraulic fluid flows down from the reservoir and behind the seals 124. The gasket 126 allows the sliding action of the piston 80 while segregating the air chamber 128 from the hydraulic fluid in the cylinders. Any air that is sucked into the spacing between seals 124 and gasket 126 will be dissipated through orifice 122. Also, the minimal expansion and contraction of space between the seal and gasket is accommodated by flow of hydraulic fluid in both directions through orifice 122. The rear mounting of the housing 66 to master cylinder 78 permits free flow of air into air chamber 128 to maintain atmospheric pressure and avoid air pressure build up in chamber 128.

A number of structural details have been left out as they would only serve to complicate the description. Such structural details include mounting of pistons 80 to the mover piston 70 (e.g. by bolt 130), and mounting of housing 66 to the stacker structure (e.g. by bolt 132 through flanges 134). Persons skilled in the art will have no problem understanding the structural requirements for these and similar details.

The invention is not limited to the specific embodiment herein described as will be obvious to those skilled in the art. The definition and scope will be determined by reference to the claims appended hereto.

I claim:

1. In a veneer stacking system wherein sheets of veneer are conveyed on an overhead conveyor and selectively deposited on stacks, apparatus for transferring the veneer sheets from the overhead conveyor to the stacks comprising;

a pair of knock-off shoes extendably supported over the sheets being conveyed by the overhead conveyor and over a stack onto which selected ones of the sheets are to be deposited, a plurality of hydraulic motor means each including a piston and defining a substantially non-restricted conduit for a hydraulic fluid moved by the piston in the conduit, said hydraulic motor means cooperatively extending the pair of shoes to engage the selected sheets and transfer the sheets from the conveyor to the stacks;

return means operating to retract the shoes to the non-extended position upon release thereof by the hydraulic motor means;

a single pneumatic control means simultaneously activating the plurality of hydraulic control means for simultaneous extension of the pair of shoes and to permit retraction thereof by the return means; and computer means controlling actuation of the pneumatic control means in response to computation of information determining the required instant of actuation of the shoes for depositing the selected sheets onto the stack.

2. Apparatus as defined in claim 1 wherein the pneumatic control means is a pneumatic cylinder and a mover piston driven by the pneumatic cylinder, said plurality of hydraulic motor means each including a master cylinder and a piston coupled through a hydraulic line to a shoe cylinder and piston, the pistons of the master cylinder being directly connected to the pneumatic driven mover piston and the pistons of the slave cylinders connected to the knock-off shoes and thereby defining a hydraulic system whereby movement of the mover piston simultaneously moves the pistons of the master cylinder which in turn simultaneously moves the pistons of the slave cylinders and knock-off shoes connected thereto.

3. Apparatus as defined in claim 2 including bleed off means for automatically bleeding off air that becomes entrained in the hydraulic line.

4. Apparatus as defined in claim 3 wherein bleed off means includes provision for mounting the master cylinder so as to establish a highest point in the hydraulic system within the master cylinder and a bleed off orifice provided in the master cylinder from the said highest point upwardly to a hydraulic fluid reservoir at the master cylinder exterior, whereby air introduced into the hydraulic system rises throughout the system and is automatically bled off through the orifice into the reservoir.

5. Apparatus as defined in claim 4 wherein the highest point of the hydraulic system is located immediately forward of the piston of the master cylinder with the piston fully retracted.

6. Apparatus as defined in claim 2 including air return means connected to the shoe cylinders on the side of the pistons opposite the hydraulic fluid for facilitating retraction of the pistons and shoes connected thereto upon retraction of the mover piston.

7. A method of stacking veneer sheets into stacks positioned below an overhead conveyor conveying veneer sheets in sequence, said stacks segregating the veneer sheets into categories of common physical characteristics, which method comprises;

scanning the sheets for the physical characteristics that determine stack designation, computing the requirements for orienting the sheets relative to the conveyor, orienting the sheets being conveyed with a leading edge thereof perpendicular to the path of travel, monitoring the position of the sheets as they are conveyed along said conveyor, positioning pairs of extendable knock-off shoes above the conveyor and above the stack position, each pair of knock-off shoes extended simultaneously by actuation of a plurality of hydraulic motor means which forces hydraulic fluid through a non-restricted conduit, and wherein said plurality of hydraulic motor means is actuated by a common computer controlled pneumatic motor means, urging the knock-off shoes to a non-extended position, and computing from the information of the monitoring and scanning steps the precise point of actuation for simultaneous extension of the pair of knock-off shoes so as to deposit the sheets onto the designated stacks while maintaining the orientation established in the orienting step and returning the knock-off shoes to the non-extended position following conclusion of the actuation step.

8. A method as defined in claim 7 including the step of bleeding off air bubbles entrained in the hydraulic motor means for insuring precise simultaneous actuation of the pair of knock-off shoes.

9. A method as determined in claim 8 wherein retraction of the knock-off shoes is provided by air pressure continuously urging retraction of the shoe cylinders and effecting retraction thereof as permitted by the motor means.

* * * * *